US006466224B1

(12) United States Patent
Nagata et al.

(10) Patent No.: US 6,466,224 B1
(45) Date of Patent: Oct. 15, 2002

(54) IMAGE DATA COMPOSITION AND DISPLAY APPARATUS

(75) Inventors: Atsushi Nagata, Hirakata (JP); Masayuki Masumoto, Sakai (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/487,250

(22) Filed: Jan. 19, 2000

(30) Foreign Application Priority Data

Jan. 19, 1999 (JP) ..... 11-010142

(51) Int. Cl.[7] ..... G09G 5/02
(52) U.S. Cl. ..... 345/592; 345/594
(58) Field of Search ..... 345/591, 592, 345/589, 593, 597, 598, 599, 600, 601, 602, 603, 604, 605, 606, 641, 640, 646, 594; 348/582, 586, 650

(56) References Cited

U.S. PATENT DOCUMENTS 5,307,452 A * 4/1994 Hahn et al. ..... 345/592
5,388,204 A * 2/1995 Ikeda et al. ..... 345/538
5,398,684 A * 3/1995 Hardy ..... 600/391
5,450,097 A 9/1995 Takebe ..... 345/690
5,473,737 A * 12/1995 Harper ..... 345/592
5,602,655 A 2/1997 Arakawa et al. ..... 358/501
5,619,227 A 4/1997 Takebe ..... 345/690
5,724,494 A * 3/1998 Politis ..... 345/592
5,907,315 A * 5/1999 Vlahos et al. ..... 382/167
5,977,981 A * 11/1999 Brown ..... 345/581

* cited by examiner

*Primary Examiner*—Michael Razavi
*Assistant Examiner*—Thu-Thao Havan
(74) *Attorney, Agent, or Firm*—Wenderoth, Lind & Ponack, L.L.P.

(57) ABSTRACT

An image data composition apparatus includes a color table in which color data for each of plural color codes is associated with transparency data relating to the transparency of this color data. The color table receives first image data which has data relating to the color of an image as the color code, accepts the color code from the first image data, and outputs the color data and the transparency data which correspond to this color code. The apparatus further includes a composition unit which receives second image data having, as color data, information relating to the color of an image, and composes the color data of this second image data with the color data output from the color table in accordance with a transparency which is decided by the transparency data. Accordingly, the number of transparent colors can be increased by only rewriting the transparency data of the color codes to be transparent colors on the color table and, therefore, the circuit scale is not increased to increase the number of transparent colors. Further, since the transparency data corresponding to each color code is directly output from the color table, the processing cycle is not increased.

14 Claims, 14 Drawing Sheets

| | | | | |
|---|---|---|---|---|
| 0 | R(0) | G(0) | B(0) | T(0) |
| ⋮ | ⋮ | ⋮ | ⋮ | ⋮ |
| u | R(u) | G(u) | B(u) | T(u) |
| u+1 | R(u+1) | G(u+1) | B(u+1) | T(u+1) |
| ⋮ | ⋮ | ⋮ | ⋮ | ⋮ |
| 255 | R(255) | G(255) | B(255) | T(255) |

Fig.7

| | |
|---|---|
| 000 | 0.0 |
| 001 | 0.2 |
| 010 | 0.4 |
| 011 | 0.6 |
| 100 | 0.8 |
| 101 | 1.0 |

Fig.11

| transparency selection signal | transparency code | coefficient 1 | coefficient 2 |
|---|---|---|---|
| 0 | 00 | 0.00 | 1.00 |
| | 01 | 0.25 | 0.75 |
| | 10 | 0.50 | 0.50 |
| | 11 | 0.75 | 0.25 |
| 1 | 00 | 1.00 | 0.00 |
| | 01 | 0.25 | 0.75 |
| | 10 | 0.50 | 0.50 |
| | 11 | 0.75 | 0.25 |

IMAGE DATA COMPOSITION AND DISPLAY APPARATUS

FIELD OF THE INVENTION

The present invention relates to an image data composition apparatus for laying an image including a transparent color over a background image.

BACKGROUND OF THE INVENTION

In recent years, with the development of high-performance car navigation systems and satellite broadcast receivers, image display units employed in these devices perform composition of image data using transparent colors, such as composition of semi-transparent non-rectangular objects or screen display of transparent color menu.

FIG. 12 is a functional block diagram illustrating a conventional image display apparatus for composing a transparent color image with a background image. The image display apparatus comprises an image data composition unit 110, a first image memory 20, a second image memory 30, a digital-to-analog converter 40, a monitor 50, and a controller 180.

The first image memory 20 stores image data 100 to be laid over a background image. The image data 100 possesses a color code which indicates information relating to the color of each pixel, and it is supplied from an external CPU (Central Processing Unit) or the like through a bus. The second image memory 30 stores image data 200 as a background. The image data 200 possesses RGB type color data which indicates information relating to the color of each pixel, and it is supplied from an external CPU or the like through a bus. The controller 180 controls pixel-by-pixel output of the color data or the color code from these image data to the image data composition unit 110. The digital-to-analog converter (DAC) 40 converts digital data output from the image data composition unit 110 to an analog image signal. The monitor 50 displays an image on the basis of this image signal.

The image data composition unit 110 comprises a color table 111, a transparency register 112, a transparency decision unit 115, a selector 113, and a compositor 114. The color table 111 contains color data corresponding to plural color codes, and outputs a color data signal d1 in response to a color code signal c1 obtained from the first image memory 20. The transparency register 112 stores one transparency $\alpha$0.

The transparency decision unit 115 stores the color code of a color to be a transparent color, and outputs a hit signal s only when the color code c1 output from the first image memory 20 is equal to the stored color code. On receipt of the hit signal s, the selector 113 selects the transparency $\alpha$0 stored in the transparency register 112 and outputs it as a transparency signal $\alpha$. When there is no hit signal s, the selector 113 outputs "0" as a transparency signal $\alpha$. Here, "0" means that the transparency is 0, i.e., an opaque color.

FIG. 13 is a block diagram illustrating the transparency decision unit 115 and the selector 113 in more detail. As shown in FIG. 13, the transparency decision unit 115 comprises transparent color registers 1151*a* and 1151*b* and comparators 1152*a* and 1152*b*. The transparent color registers 1151*a* and 1151*b* store the color codes of colors to be transparent colors. The comparators 1152*a* and 1152*b* are connected to the color registers 1151*a* and 1151*b*, respectively. Each of these comparators outputs a hit signal s only when the color code c1 output from the first image memory 20 is equal to the color code stored in the transparent color register 1151*a* or 1151*b*. The selector 113 comprises a tri-state gate 1131*a* and a tri-state gate 1131*b*. The tri-state gate 1131*a* outputs the transparency $\alpha$0 stored in the transparency register 112 on receipt of the hit signal s, and the tri-state gate 1131*b* outputs "0" when there is no hit signal s.

The compositor 114 composites a color data signal d2 which is obtained from the second image data 200 with a color data signal d1 which corresponds to the first image data 100 and is obtained from the color table 111 in accordance with the color code signal c1, pixel by pixel, on the basis of the transparency signal $\alpha$, and outputs composite image data dm as the result of composition.

Hereinafter, the operation of the image data composition apparatus so constructed will be described. Initially, the color data stored in the second image memory 30 is read by raster scan under control of the controller 180 to be output to the compositor 114 as a color data signal d2. Likewise, the color code signal c1 is output from the first image memory 20 by raster scan, and converted to a color data signal d1 by the color table 111 to be output to the compositor 114.

On the other hand, the color code signal c1 read from the first image memory 20 is also input to the transparency decision unit 115. In the transparency decision unit 115, the color code represented by the color code signal c1 is compared with the color codes stored in the transparent color registers 1151*a* and 1151*b* by the comparators 1152*a* and 1152*b*, respectively. When it is equal to any of these color codes stored, a hit signal s is output to the selector 113, and when it is equal to none of these color codes, no hit signal is output. When the selector 113 receives the hit signal s, the tri-state gate 1131*a* outputs the transparency $\alpha$0 which is set in the transparency register 112, as a transparency signal $\alpha$, to the compositor 114. When no hit signal is input to the selector 113, the tri-state gate 1131*b* outputs "0" as a transparency signal a to the compositor 114. The compositor 114 composes the color data d1 of the first image data and the color data d2 of the second image data, pixel by pixel, in accordance with the transparency signal $\alpha$, and outputs composite data. The composite data is converted to an analog image signal by the digital-to-analog converter 40, and the analog image signal is sent to the monitor 50 to be displayed as an image.

In the conventional image data composition unit 110 constructed as described above, the transparency decision unit 115 needs transparent color registers and comparators as many as the number of colors to be set as transparent colors. For example, in the conventional composition unit 110, since the transparency decision unit 115 has two transparent color registers 1151*a* and 1151*b* and two comparators 1152*a* and 1152*b*, two transparent colors can be set. However, when ten transparent colors are desired to be set, ten transparent color registers and ten comparators are required. In this way, the circuit scale increases in proportion to the number of transparent colors to be set. It is possible to perform the above-described comparison process in time division by providing only one comparator for a plurality of transparent color registers. In this case, however, the number of process cycles increases.

SUMMARY OF THE INVENTION

The present invention is made to solve the above-described problems, and it is an object of the present invention to provide an image data composition apparatus which can increase the number of settable transparent colors without increasing the circuit scale and the processing cycle.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, there is provided an image data composition apparatus comprising: a color table in which color data for each of plural color codes is associated with transparency data relating to the transparency of this color data, the color table receiving first image data which has data relating to the color of an image as the color code, and accepting the color code from the first image data, and outputting the color data and the transparency data which correspond to this color code; and a composition unit for receiving second image data having, as color data, information relating to the color of an image, and composing the color data of this second image data with the color data output from the color table in accordance with a transparency which is decided by the transparency data. Accordingly, the number of transparent colors can be increased by only rewriting the transparency data of the color codes to be transparent colors on the color table and, therefore, the circuit scale is not increased to increase the number of transparent colors. Further, since the transparency data corresponding to each color code is directly output from the color table, the processing cycle is not increased.

According to a second aspect of the present invention, the image data composition apparatus of the first aspect further comprises: a transparency storage unit for storing at least two transparencies; a transparency selection unit for selecting one of the transparencies stored in the transparency storage unit, on the basis of the transparency data; and the composition unit for composing the color data in accordance with the transparency selected by the transparency selection unit. Since the transparency data is used only for selection by the transparency selection unit, the quantity of data can be reduced as compared with the case where the transparency having relatively large quantity of data is directly stored in the color table. Further, since different color codes having the same transparency are put together in the transparency storage unit, the entire storage area can be used with high efficiency.

According to a third aspect of the present invention, the image data composition apparatus of the first aspect further comprises: a transparency code storage unit for storing at least two transparency codes; a transparency code selection unit for selecting one of the transparency codes stored in the transparency code storage unit, on the basis of the transparency data; a transparency table in which plural transparency codes are associated with the corresponding transparencies, the transparency table receiving the transparency code selected by the transparency code selection unit, and outputting a transparency corresponding to this code; and the composition unit for composing the respective color data in accordance with the transparency output from the transparency table. Since each transparency code has only the quantity of data required for selecting the transparency, the number of input terminals of the transparency code selection unit and the number of signal lines inside the selection unit are reduced as compared with the case where the selection unit selects the transparency itself, whereby the circuit installed area can be used with higher efficiency.

According to a fourth aspect of the present invention, in the image data composition apparatus of the first aspect, the composition unit comprises: a first multiplier for accepting a coefficient specification signal which is composed of at least one bit decided by the transparency data, and specifying a first coefficient corresponding to the transparency of the color data of the first image data in accordance with the coefficient specification signal, and multiplying the color data of the first image data by this first coefficient; a second multiplier for accepting the coefficient specification signal, and specifying a second coefficient corresponding to the transparency of the color data of the second image data in accordance with the coefficient specification signal, and multiplying the color data of the second image data by this second coefficient; and an adder for adding the products output from the first multiplier and the second multiplier. Since composition of image data requires only selection of coefficient arithmetic, the circuit structure of the composition unit can be simplified as compared with the case where arithmetic is performed with transparency.

According to a fifth aspect of the present invention, the image data composition apparatus of the fourth aspect further comprises: a transparency code storage unit for storing at least two transparency codes each being composed of at least one bit; and a transparency code selection unit for selecting one of the transparency codes stored in the transparency code storage unit, on the basis of the transparency data. The transparency data is composed of at least one bit, and the coefficient specification signal is composed of the transparency data and the transparency code. Since different color codes having the same transparency are put together in the transparency storage unit, the entire storage area can be used with high efficiency as compared with the case where all of the bits constituting the coefficient specification signal as the transparency selection data are stored.

According to a sixth aspect of the present invention, the image data composition apparatus of the first aspect further comprises a buffer memory for storing data which is generated as the result of composition by the composition unit, and outputting this data as the second image data to the composition unit. Therefore, when composing plural frames of image data, the number of colors to be set as transparent colors can be increased regardless of the number of frames to be composed, without increasing the circuit scale and processing cycle.

According to a seventh aspect of the present invention, there is provided an image display apparatus including an image data composition apparatus according to any of the first to sixth aspects. Therefore, in the image display apparatus, the number of colors to be set as transparent colors can be increased without increasing the circuit scale and processing cycle.

BRIEF DESCRIPTION OF THE DRAWINGS

FIG. 7 is a diagram illustrating the contents of a transparency table, for explaining the image display apparatus of the second embodiment.

FIG. 11 is a diagram illustrating the relationships between first coefficients 1 and second coefficients 2 corresponding to transparency selection signals and transparency codes, for explaining the image display apparatus of the third embodiment.

DETAILED DESCRIPTION OF THE PREFERRED EMBODIMENTS

Hereinafter, preferred embodiments of the present invention will be described with reference to the drawings.

[Embodiment 1]

Figure 1:
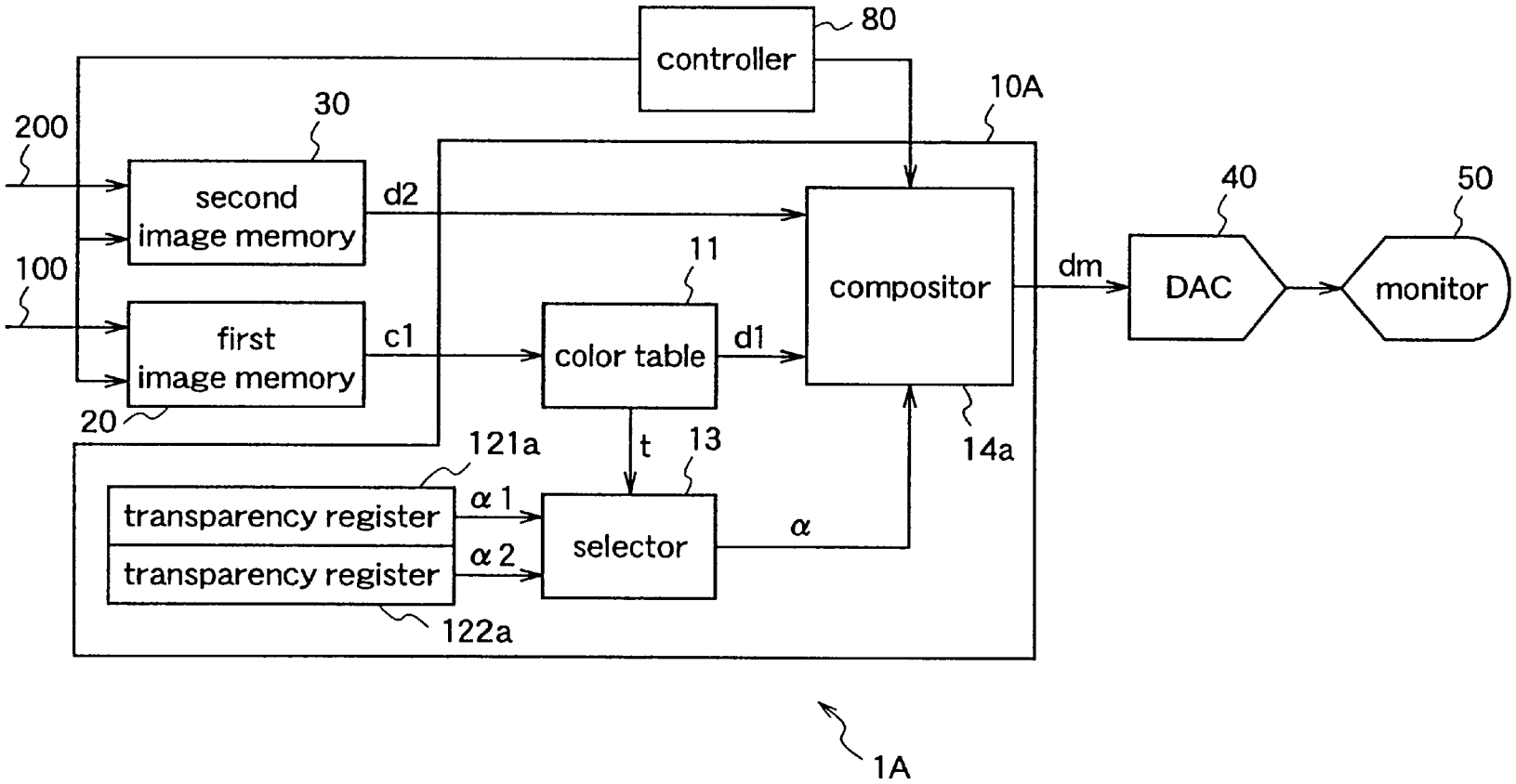
FIG. 1 is a functional block diagram illustrating the structure of an image display apparatus according to a first embodiment of the present invention.

FIG. 1 is a block diagram illustrating an image display apparatus 1A according to a first embodiment of the present invention. The image display apparatus 1A comprises an image data composition unit 10A, a first image memory 20, a second image memory 30, a digital-to-analog converter (DAC) 40, a monitor 50, and a controller 80.

The first image memory 20 stores image data 100 supplied from an external CPU or the like through a bus, and the image data 100 possesses color codes which indicate information about the colors of pixels. The stored color codes are output, pixel by pixel, as a color code signal c1 to the image data composition unit 10A. The second image memory 30 stores image data 200 supplied from an external CPU or the like through a bus, and the image data 200 possesses RGB type color data which indicate information about the colors of pixels. The stored color data are output, pixel by pixel, as color data d2 to the image data composition unit 10A. The digital-to-analog converter 40 converts digital image data output from the image data composition unit 10A to an analog image signal. The monitor 50 displays an image according to the analog image signal transmitted from the digital-to-analog converter 40. The controller 80 sends a predetermined control signal to the first image memory 20, the second image memory 30, and the image data composition unit 10A at predetermined timing, whereby the color codes and the color data from the first image memory 20 and the second image memory 30 are synchronously input, pixel by pixel, to the image data composition unit 10A. Further, the controller 80 controls output timing of image data from the image data composition unit 10A.

The image data composition unit 10A composes plural pieces of input image data having portions of transparent colors. The composition unit 10A comprises a color table 11, transparency registers 121*a* and 122*a*, a selector 13, and a compositor 14*a*. Hereinafter, these constituents will be described in detail.

Figures 2, 3:
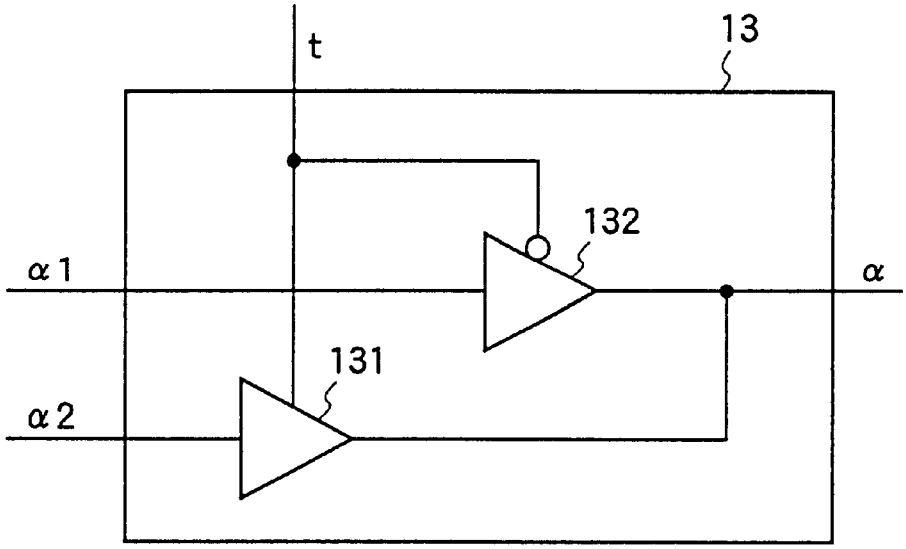
FIG. 2 is a diagram schematically illustrating the contents of a color table, for explaining the image display apparatus of the first embodiment.
FIG. 3 is a block diagram illustrating the structure of a selector, for explaining the image display apparatus of the first embodiment.

The color table 11 is implemented by a memory, and it receives a color code signal c1 output from the first image memory 20. The contents of the color table 11 are shown in FIG. 2. The color table 11 has addresses 0~255 wherein color data R, G, and B indicating the RGB luminance values and transparency selection data T (transparency data) are stored. Each of the color data R, G, and B comprises five bits, and the transparency selection data T comprises one bit. The number of bits of the color data (R, G, B) is not restricted to five. When an address value is given as a color code, color data corresponding to this is output as a color data signal d1 to the compositor 14*a* and, simultaneously, the transparency selection data T is output as a transparency selection signal t to the compositor 14*a*. That is, the address value corresponds to the color code. So, when a color code u is given by the color code signal c1, color data R(u), G(u), and B(u) and transparency selection data T(u), which are recorded in address u, are output.

The transparency registers 121*a* and 122*a* store a transparency $\alpha 1$ and a transparency $\alpha 2$ ($0 \leqq \alpha 1$, $\alpha 2 \leqq 1$), respectively. These transparencies $\alpha 1$ and $\alpha 2$ are set in the corresponding registers by the user as desired. When the value of one of these registers is fixed to 0, one of the two input terminals of the selector 13 is grounded, instead of providing the register.

With reference to FIG. 3, the selector 13 comprises a tri-state gate 131 which opens when "1" is applied to its control terminal, and a tri-state gate 132 which opens when "0" is applied to its control terminal. The tri-state gate 131 is connected to the transparency register 122*a* while the tri-state gate 132 is connected to the transparency register 121*a*, and the transparency selection signal t is input to each of the control terminals of the tri-state gates 131 and 132. Accordingly, when the value of the transparency selection signal t is "1", the tri-state gate 131 opens and the transparency $\alpha 2$ stored in the transparency register 122*a* is output. When the value of the transparency selection signal t is "0", the tri-state gate 132 opens and the transparency $\alpha 1$ stored in the transparency register 121*a* is output. The output transparency $\alpha 1$ or $\alpha 2$ is input to the compositor 14*a* as a transparency signal $\alpha$.

The compositor 14*a* receives, besides the transparency signal $\alpha$, the first image color data signal d1 output from the color table 11, and the second image color data signal d2 read from the second image memory 30. The compositor 14*a* has an arithmetic circuit performing the following arithmetic ①, and the compositor 14*a* composes the two color data signals according to the arithmetic ① to output a composite data signal dm.

$$dm=(1-\alpha)\times d1+\alpha\times d2 \quad ①$$

This arithmetic is performed for each of the values of R, G, B color data, and the composite data is calculated for each of R, G, B.

Next, the operation of the image display apparatus 1A so constructed will be described with reference to FIGS. 4(*a*)

~4(*c*). It is assumed that an image shown in FIG. 4(*a*) is stored in the second image memory 30 such that the colors of pixels constituting the image are stored as color data, and an image shown in FIG. 4(*b*) is stored in the first image memory 20 such that the colors of pixels constituting the image are stored as color codes. A triangle area 104 shown in FIG. 4(*a*) is filled with a color of color data p while the other area 105 is filled with a color of color data q. A circular area 106 shown in FIG. 4(*b*) is filled with a color corresponding to a color code m while the other area 107 is filled with a color corresponding to a color code l. Now, the image of FIG. 4(*b*) having the circular area 106 being opaque and the other area 107 being transparent, is laid over the image of FIG. 4(*a*).

For this purpose, initially, a transparency "0.0" indicating "opaque" is set as the transparency α1 of the transparency register 121*a* while a transparency "1.0" indicating "transparent" is set as the transparency α2 of the transparency register 122*a*. Then, in the color table 11, the value of the transparency selection data T(m) in address m corresponding to the color code m of the circular area 106 is set to "0" so that the transparency register 121*a* having the transparency "0.0" is selected. On the other hand, the value of the transparency selection data T(l) in address 1 corresponding to the color code l of the other area 107 is set to "1" so that the transparency register 122*a* having the transparency "1.0" is selected.

After the setting, image composition is performed as follows. Initially, the color data of pixels constituting the image shown in FIG. 4(*a*) are read from the second image memory 30 in order of scan lines of the monitor 50 by the controller 80, and each color data is input to the compositor 14*a* as a color data signal d2. At the same time, the color codes of the respective pixels constituting the image shown in FIG. 4(*b*) are read from the first image memory 20 in order of scan lines of the monitor 50, and each color code is input to the color table 11 as a color code signal c1. In the color table 11, the color data signal d1 corresponding to the color code indicated by the color code signal c1 is output to the compositor 14*a* and, simultaneously, the corresponding transparency selection signal t is output to the selector 13. Each pixel of the image shown in FIG. 4(*b*) has the color code l or m. When the color code is l, "1" is output as the value of the transparency selection signal t. When the color code is m, "0" is output as the value of the transparency selection signal t.

In the selector 13, either the transparency α1 stored in the transparency register 121*a* or the transparency α2 stored in the transparency register 122*a* is selected according to the value of the transparency selection signal t, and the selected transparency is output to the compositor 14*a* as a transparency signal α. When the value of the transparency selection signal t is "0", the value "0.0" which is the transparency stored in the transparency register 121*a* is output. When the value of the transparency selection signal t is "1", the value "1.0" which is the transparency stored in the transparency register 122*a* is output. That is, the value of the transparency signal α is "0.0" when the pixel has the color indicating the circular area 106, and the value of the transparency signal a is "1.0" when the pixel has the color indicating the area 107 outside the circuit area 106.

In the compositor 14*a*, by using the arithmetic circuit which realizes the above-mentioned formula ①, the color data are composed, pixel by pixel, on the basis of the color data signals d1 and d2 and the transparency signal α, and a composite data signal dm is output. Finally, the composite data signal dm is converted by the digital-to-analog converter 40, and a composite image is displayed on the monitor 50.

Figure 4:
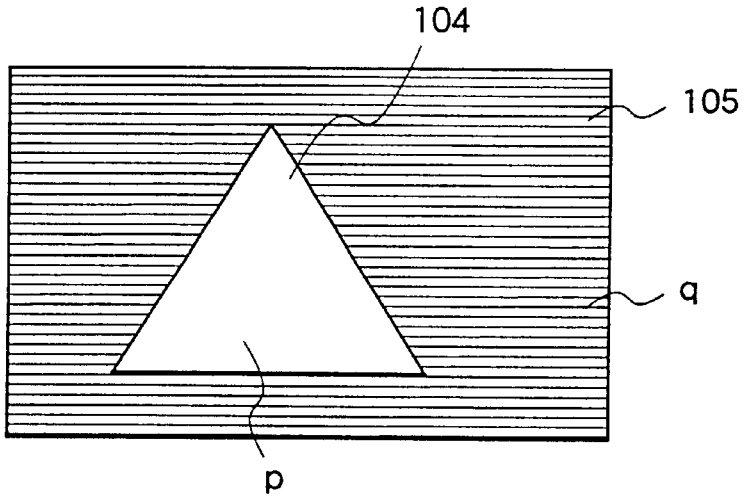
FIGS. 4(*a*)–4(*c*) are diagrams illustrating examples of images to be composed (4(*a*) and 4(*b*)) and an example of a composite image (4(*c*)), for explaining the image display apparatus of the first embodiment.
Figure 4:
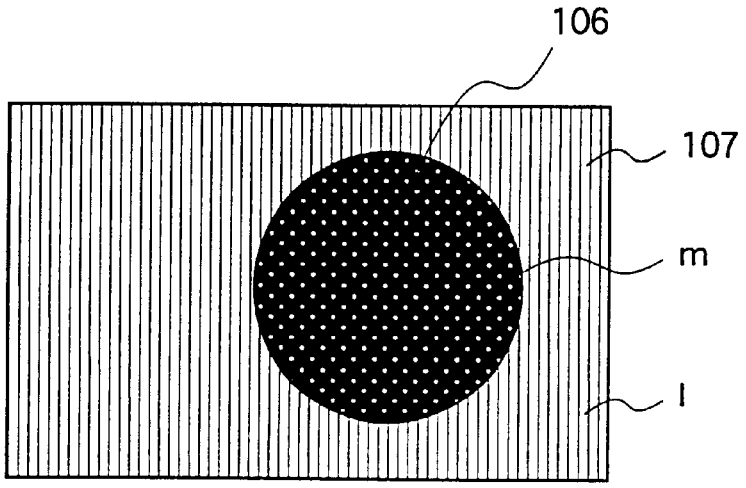
Figure 4:
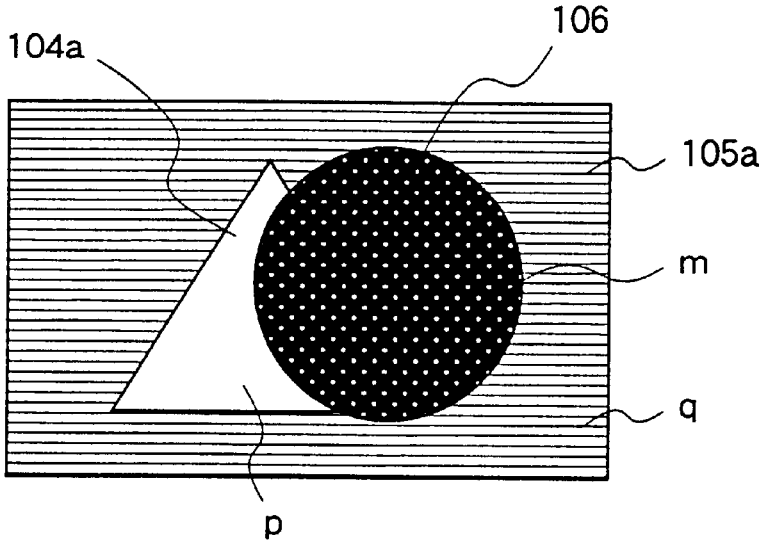

When the color data of the circular area 106 of the image shown in FIG. 4(*b*) is transmitted as the color data signal d1, the transparency "0.0" is transmitted as the transparency signal α. So, in the portion corresponding to this pixel, only the color data of the circular area 106 is output as a composite data signal dm, according to formula ①. On the other hand, when the color data of the area 107 outside the circular area 106 is transmitted as the color data signal d1, the transparency "1.0" is transmitted as the transparency signal α. So, in the portion corresponding to this pixel, the value of the color data of the area 107 becomes 0 with respect to all of R, G, and B, according to formula ①. In this case, only the color data of the pixel constituting the image shown in FIG. 4(*a*) is output as the composite data signal. Accordingly, when the composition process is completed for all of the pixels, an image shown in FIG. 4(*c*) is obtained, in which the image of FIG. 4(*b*) having the circular area 106 being opaque and the other area 107 being transparent, is laid over the image of FIG. 4(*a*). To be specific, in FIG. 4(*c*), the color data of the circular area 106 is obtained by the color code m, and the color data of a portion 104*a* of the triangle area 104 other than the overlapped portion with the circular area 106 is the color data p. Further, the color data of a portion 105*a* of the area 105 outside the triangle area 104, other than the overlapped portion with the circular area 106, is the color data q.

Figure 5:
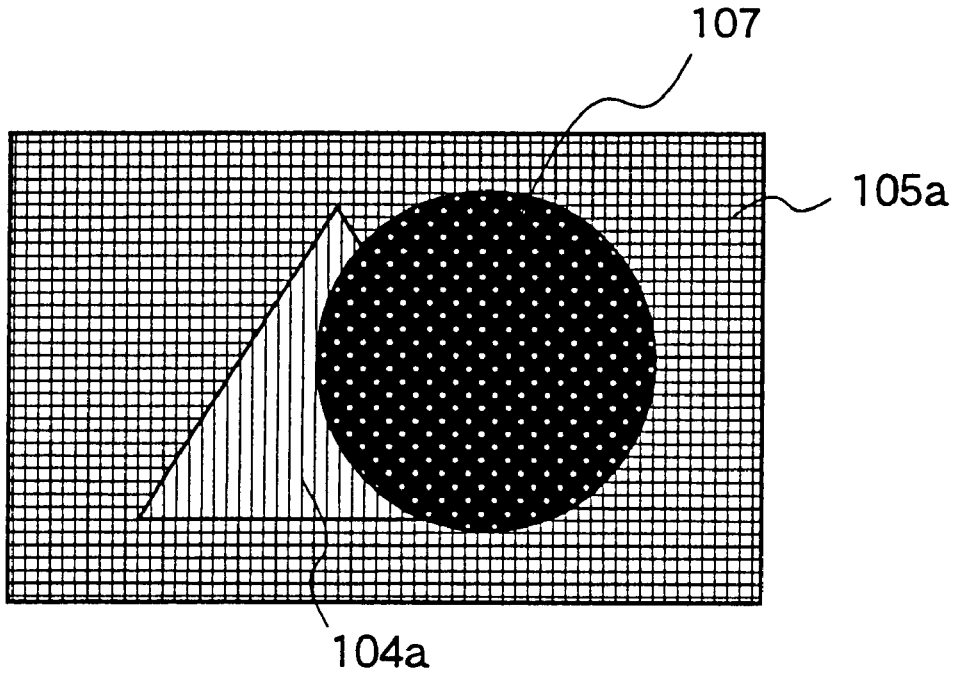
FIG. 5 is a diagram illustrating another example of a composite image obtained by composing the images of FIGS. 4(*a*) and 4(*b*), for explaining the image display apparatus of the first embodiment.

In the above-described example, the color of the area 107 outside the circular area 106 shown in FIG. 4(*b*) is perfectly transparent, this area 107 may be semi-transparent by setting a value such as "0.5" as a transparency in the transparency register 122*a*. Then, in the compositor 14*a*, arithmetic is performed with the transparency a being "0.5" for the color of the area 107 outside the circular area 106, on the basis of formula ①, whereby the area 107 is composed, as a semitransparent image, with the image of FIG. 4(*a*) as shown in FIG. 5. That is, in a portion 104*a* of the triangle area 104 other than the overlapped portion with the circular area 106, the color data obtained by the color code l (semi-transparent) is composed with the color data p. In a portion 105*a* of the area 105 outside the triangle 104 and other than the overlapped portion with the circuit area 106, the color data obtained by the color code l (semi-transparent) is composed with the color data q.

In the image data composition unit 10A according to this first embodiment, even when there are many colors to be set as transparent colors, setting of these colors can be made by only changing the transparency selection data for the corresponding color codes in the color table 11, without changing the circuit scale. Further, the processing cycle does not change even when the number of transparent colors increases. Accordingly, it is possible to provide an image data composition apparatus which can increase the number of settable transparent colors, without increasing the circuit scale and the processing cycle.

In this first embodiment, in order to efficiently use the storage capacity of the color table 11, the transparencies α1 and α2 having relatively large amounts of data are stored in the transparency registers 121*a* and 122*a*, respectively, and one of them is selected according to the value of the 1-bit transparency selection data which is stored in the color table 11. However, when the storage capacity of the color table 11 is sufficiently large, not the transparency selection data but the transparency itself corresponding to each color data may be stored as transparency data in the color table 11, and the transparency may be output directly to the compositor 14*a*. In this case, the transparency registers 121*a* and 122*a* and the selector 13 are dispensed with and, furthermore, the number of transparencies to be used at the same time can be increased without increasing the circuit scale.

[Embodiment 2]

Figure 6:
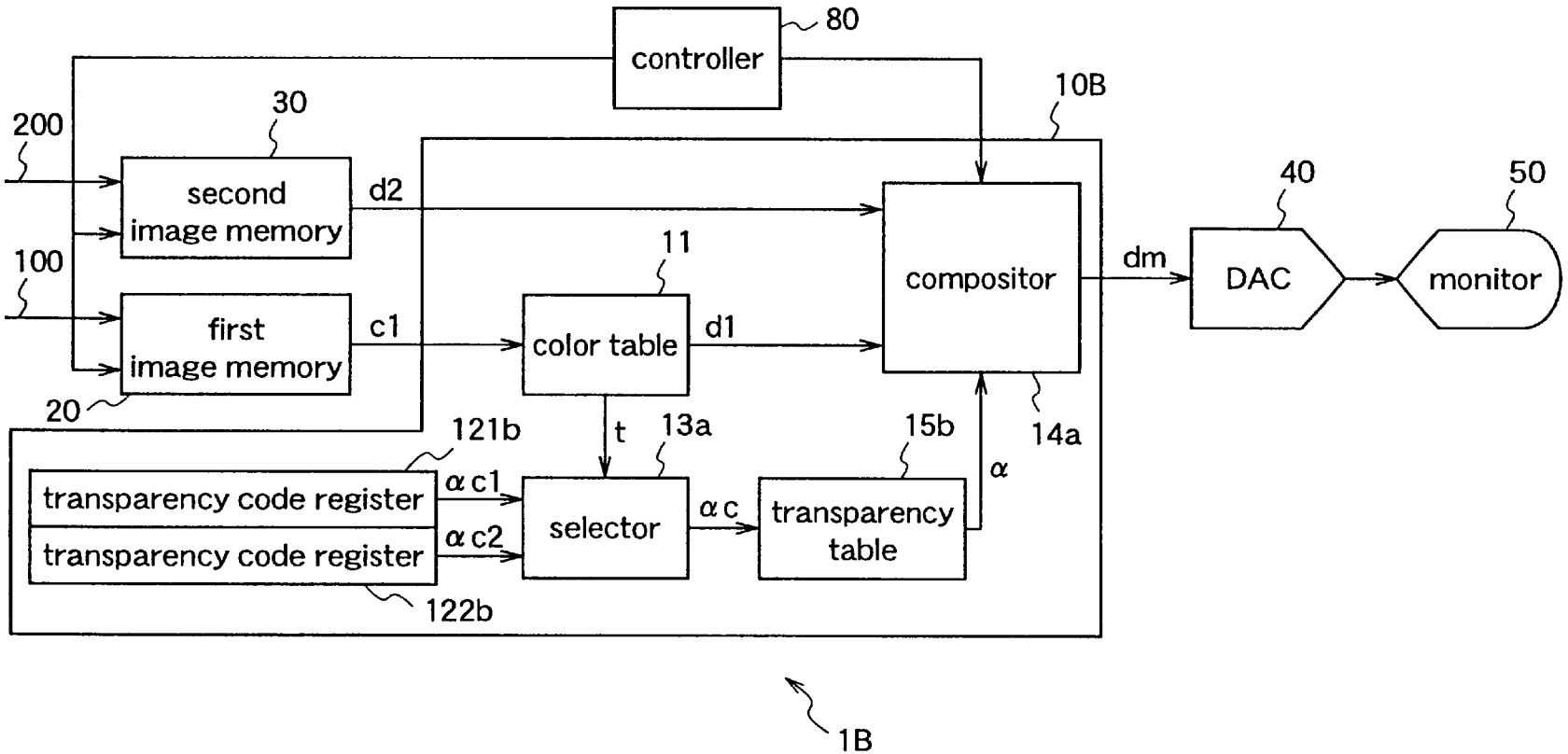
FIG. 6 is a functional block diagram illustrating the structure of an image display apparatus according to a second embodiment of the present invention.

Hereinafter, a second embodiment of the present invention will be described. FIG. 6 is a functional block diagram illustrating an image display apparatus 1B according to the second embodiment of the invention. In FIG. 6, the same reference numerals as those shown in FIG. 1 designate the same or corresponding parts. The image display apparatus 1B comprises an image data composition unit 10B, a first image memory 20, a second image memory 30, a digital-to-analog converter 40, a monitor 50, and a controller 80. The image data composition unit 10B comprises a color table 11, a transparency code registers 121*b* and 122*b*, a selector 13*a*, a compositor 14, and a transparency table 15*b*.

The image display apparatus 1B of this second embodiment is fundamentally identical to the image display apparatus 1A of the first embodiment except that the image data composition unit 10B includes the transparency table 15*b*, and the transparency code registers 121*b* and 122*b* for storing transparency codes in place of the transparency registers 121*a* and 122*a* for storing transparencies.

The transparency code registers 121*b* and 122*b* store transparency codes αc1 and αc2, respectively. Each transparency code comprises 3 bits, and a transparency is associated with each transparency code by the transparency table 15*b* described later. The user sets the transparency codes corresponding to desired transparencies with reference to the table 15*b*, in the transparency code registers 121*b* and 122*b*. The number of bits of each transparency code may be equal to the number of bits of each address in the transparency table, whereby a transparency having relatively large number of digits can be controlled with relatively small number of bits. The selector 13*a* selects one of the transparency codes αc1 and αc2 stored in the transparency code registers 121*b* and 122*b*, according to the value of a transparency selection signal t output from the color table 11, and outputs it as a transparency code signal αc to the transparency table 15*b*.

The transparency table 15*b* is implemented by a memory. FIG. 7 shows the contents of the transparency table 15*b*. In the transparency table 15*b*, addresses 000~101 correspond to transparency codes each comprising 3 bits, and a transparency is stored in each address. On receipt of the transparency code signal αc, the transparency table 15*b* outputs a transparency stored in an address corresponding to the transparency code, as a transparency signal α, to the compositor 14*a*.

Figure 14:
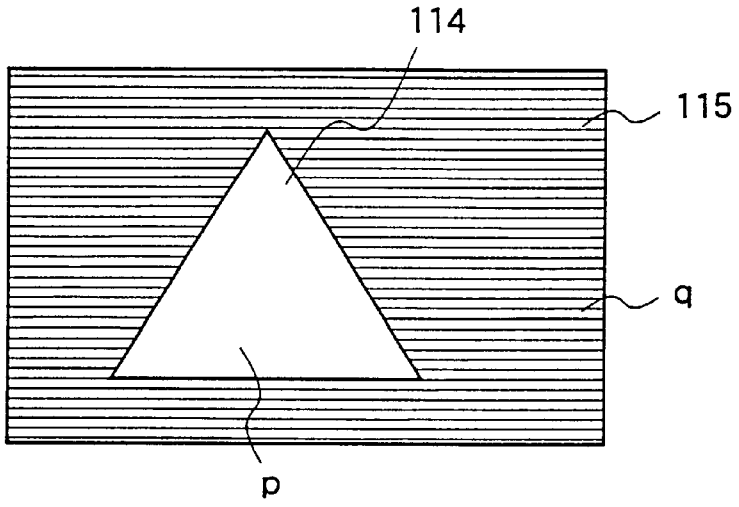
FIGS. 14(*a*)–14(*c*) are diagrams illustrating examples of images to be composed (14(*a*) and 14(*b*)) and an example of a composite image (14(*c*)), for explaining the image display apparatus of the second embodiment.
Figure 14:
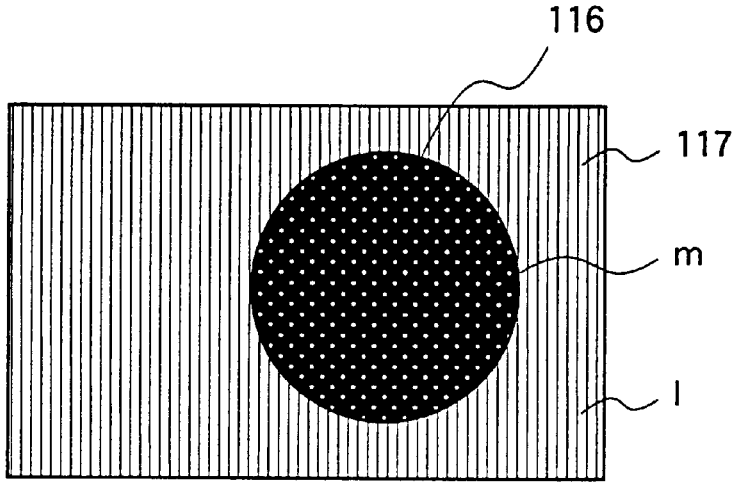
Figure 14:
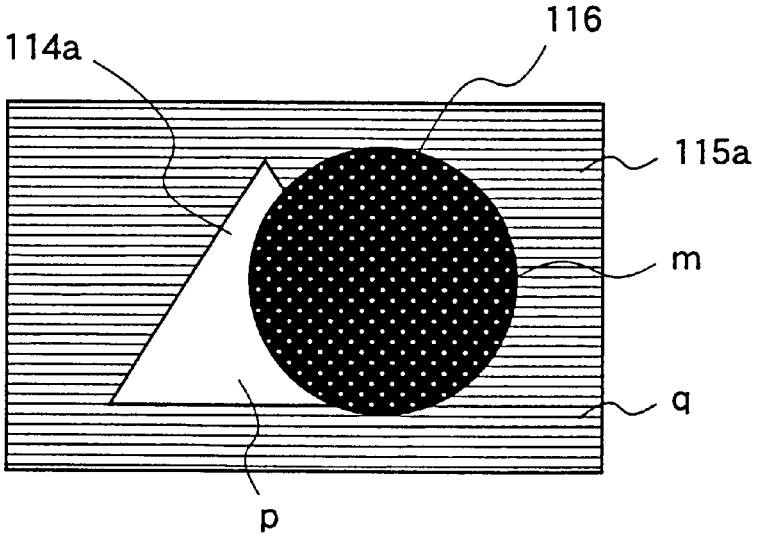

Hereinafter, the operation of the image display apparatus 1B will be described with reference to FIGS. 14(*a*)~14(*c*). It is assumed that an image shown in FIG. 14(*a*) is stored in the second image memory 30 such that the colors of pixels constituting the image are stored as color data, and an image shown in FIG. 14(*b*) is stored in the first image memory 20 such that the colors of pixels constituting the image are stored as color data. In FIG. 14(*a*), a triangle area 114 is filled with a color of color data p while the other area 115 is filled with a color of color data q. In the color table 11, the value of transparency selection data T(m) corresponding to a color code m of a circular area 116 shown in FIG. 14(*b*) is set to "1" while the value of transparency selection data T(l) corresponding to a color code l of the other area 117 is set to "0". Further, "000" is set as a transparency code αc1 in the transparency code register 121*b* while "101" is set as a transparency code αc2 in the transparency code register 122*b*. A description is now given to the case where the image of FIG. 14(*b*) with the circular area 116 being opaque and the other area 117 being transparent, is laid over the image of FIG. 14(*a*).

Initially, under control of the controller 80, a color data signal d2 corresponding to each pixel is output from the second image memory 30 to the compositor 14*a*, and a color code signal c1 corresponding to each pixel is output from the first image memory 30 to the color table 11. Further, a color data signal d1 corresponding to the color code is output from the color table 11 to the compositor 14*a*.

The color table 11 outputs the color data signal d1 and, simultaneously, outputs a transparency selection signal t corresponding to the color code to the selector 13*a*. The selector 13*a* selects either the transparency code stored in the transparency code register 121*b* or the transparency code stored in the transparency code register 122*b* in accordance with the value of the transparency selection signal t, and outputs it as a transparency code signal ac to the transparency table 15*b*. When the color code m of the circular area 116 shown in FIG. 4(*b*) is read from the first image memory 20, the transparency code "000" is output as a transparency code signal ac according to the transparency selection signal of "0". When the color code l of the area 117 other than the circular area 116 is read from the first image memory 20, the transparency code "101" is output as a transparency code signal αc according to the transparency selection signal of "1".

In the transparency table 15*b*, the transparency which is stored in an address equal to the value of the transparency code signal αc is output as a transparency signal α to the compositor 14*a*. To be specific, with reference to the transparency table shown in FIG. 7, a transparency "0.0" is output as a transparency code signal α for the transparency code "000" corresponding to the color code m of the circular area 116, while a transparency "1.0" is output as a transparency code signal α for the transparency code "101" corresponding to the color code l of the area 117 other than the circular area 116. Then, in the compositor 14*a*, arithmetic which satisfies formula ① is performed according to these transparency signals α, whereby the image stored in the first image memory and the image stored in the second image memory are composited pixel by pixel, and a composite image is displayed on the monitor 50 through the digital-to-analog converter 40. In this second embodiment, since the same transparencies as those used for the first embodiment are set for the image of FIG. 14(*b*), the composite image shown in FIG. 14(*c*) is identical to the image shown in FIG. 4(*c*). That is, in FIG. 14(*c*), the color data of the circular area 116 is obtained by the color code m, and a portion 104*a* of the triangle area 104 (FIG. 14(*a*)) other than the overlapped portion with the circular area 106 has the color data p, and a portion 105*a* of the area 105 (FIG. 4(*a*)) other than the overlapped portion with the circular area 106 has the color data q.

In this second embodiment of the invention, after the selector 13*a* selects the transparency code having smaller number of bits than that of the transparency itself, the selected transparency code is converted to the corresponding transparency by the transparency table 15*b* and then output to the compositor 14*a*. Therefore, as compared with the first embodiment in which the transparency itself is selected by the selector 13*a* to be output to the compositor 14*a*, the number of signal lines in the selector 13*a* and the number of signal lines extended to the selector 13*a* are reduced, whereby the circuit installed area can be utilized more effectively. This effect is conspicuous when the number of bits constituting the transparency is large or when the number of transparencies actually used for image data composition is large.

Further, in this second embodiment, a transparency can be set to a simple transparency code. Therefore, while in the first embodiment a desired transparency itself must be set in the transparency register, in this second embodiment a transparency code which is simpler, i.e., has less number of bits, than the corresponding transparency, is set in the transparency code register, whereby the user's effort in setting transparencies can be reduced.

Further, the image data composition unit 10B of this second embodiment may be modified as follows. That is, the transparency table 15*b* is modified such that each address is constituted by one bit, and a transparency selection signal t output from the color table 11 is directly input to the transparency table 15*b*, whereby the transparency stored in the address equal to the value of the transparency selection signal t is output to the compositor 14*a*. In this case, the user can set transparencies directly in the transparency table 15*b*. Thereby, although the user's setting of transparencies is complicated, the transparency code registers 121*b* and 122*b* and the selector 13*a* can be dispensed with.

[Embodiment 3]

Figure 8:
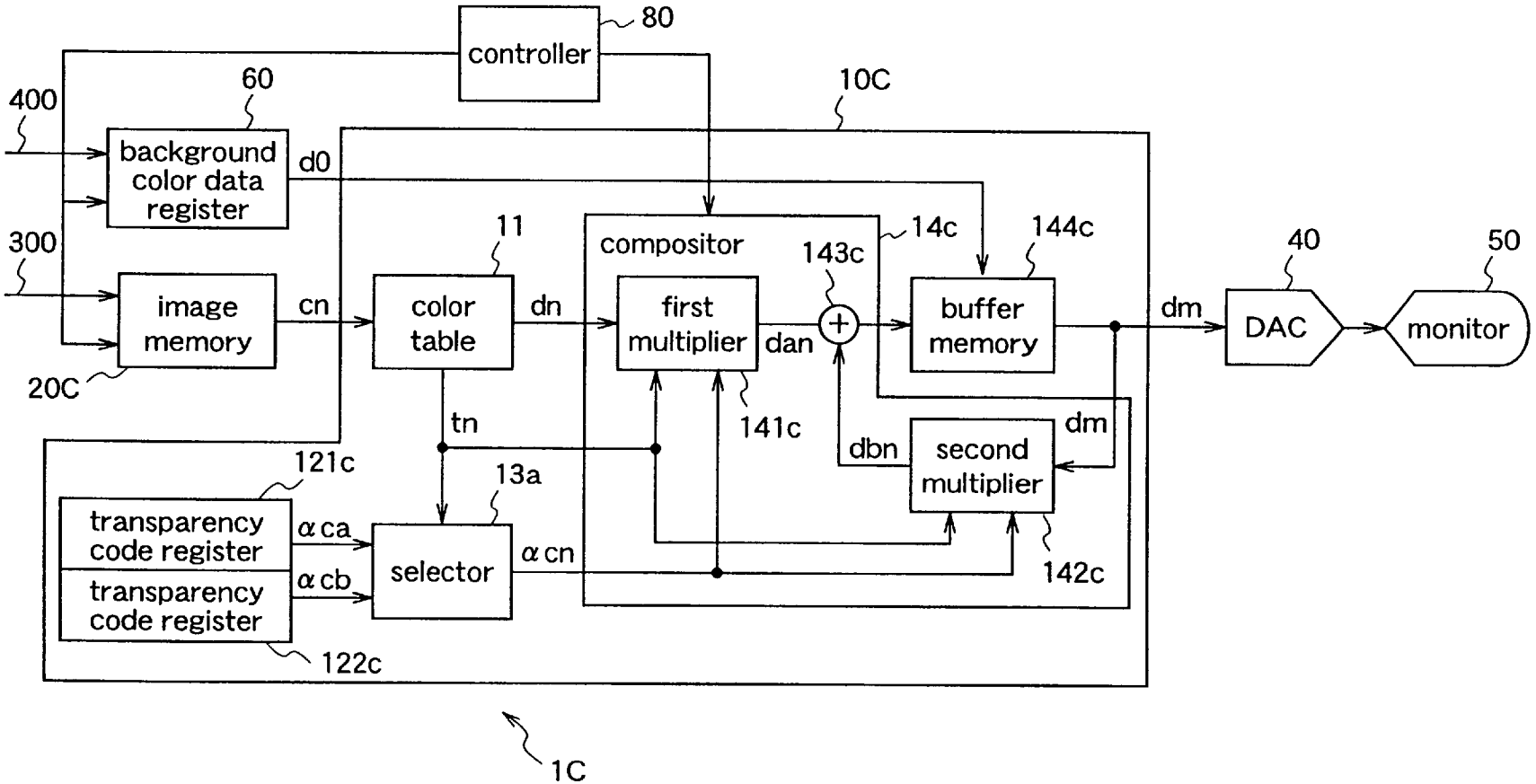
FIG. 8 is a functional block diagram illustrating the structure of an image display apparatus according to a third embodiment of the present invention.

Next, a third embodiment of the present invention will be described. FIG. 8 is a functional block diagram illustrating an image display apparatus 1C according to the third embodiment. In FIG. 8, the same reference numerals as those shown in FIG. 6 designate the same or corresponding parts. The image display apparatus 1C comprises an image data composition unit 10C, an image memory 20C, a digital-to-analog converter 40, a monitor 50, a background color data register 60, and a controller 80. The image data composition unit 10C comprises a color table 11, transparency code registers 121*c* and 122*c*, a selector 13*a*, a compositor 14*c*, and a buffer memory 144*c*.

The image display apparatus 1C is different from the image display apparatus 1B according to the second embodiment in that it has the image memory 20C and the background color data register 60 instead of the first and second image memories 20 and 30. The image memory 20C stores plural pieces of image data 300, each having a color code which indicates information about the color of each pixel. The image data 300 are supplied from an external CPU or the like through a bus. The image memory 20*c* outputs these color codes, image by image, as a color code signal cn (n=1,2, . . . ; n varies image by image) to the color table 11. Further, the background color data register 60 stores one piece of background color data 400 of an image which is assumed as a backmost plane. The background color data 400 is supplied from an external CPU or the like through a bus. The background color register 60 outputs this color data sa a background color data signal d0 to the buffer memory 144*c*. In this third embodiment, a color data signal, a transparency selection signal, and a transparency code signal are respectively represented as dn, tn, αcn in accordance with the color code signal cn output from the image memory 20C.

Further, in the image display apparatus 1C of this third embodiment, the image data composition unit 10C has no transparency table, and the structure of the compositor 14*c* is different from that of the compositor 14*a* according to the first and second embodiments. Each of the transparency code registers 121*c* and 122*c* stores a transparency code as 2-bit data. Also a transparency selection signal tn output from the color table 11 is input to the compositor 14*c*. The buffer memory 144*c* receives the color data signal d0 from the background color data register 60, and stores the output from the compositor 14*c*. The controller 80 performs control with the above-described alteration in structure.

The compositor 14*c* comprises a first multiplier 141*c*, a second multiplier 142*c*, and an adder 143*c*. The first multiplier 141*c* subjects the value of color data indicated by the color data signal dn transmitted from the color table 11 to arithmetic which depends on the transparency signal tn and the transparency code αcn, and outputs the arithmetic result as a color data signal dan to the adder 143*c*. The second multiplier 142*c* subjects the value of color data stored in the buffer memory 144*c* to arithmetic which depends on the transparency signal tn and the transparency code αcn, and outputs the arithmetic result as a color data signal dbn to the adder 143*c*. These arithmetic operations will be later described in more detail. The adder 143*c* adds the arithmetic results from the first and second multipliers 141*c* and 142*c*, and outputs the sum to the buffer memory 144*c*. In the buffer memory 144*c*, storage locations are assigned to the respective pixels of images to be composed, and the buffer memory 144*c* stores, pixel by pixel, the result output from the adder 143*c* and the color data transmitted from the background color data register 60. When the color data of the same pixel is transmitted from the adder 143*c*, the transmitted color data overwrites the color data stored in the storage location of this pixel. Further, the color data stored in the buffer memory 144*c* is output as a composite data signal dm to the second multiplier 142*c* and to the digital-to-analog converter 40.

Figure 9:
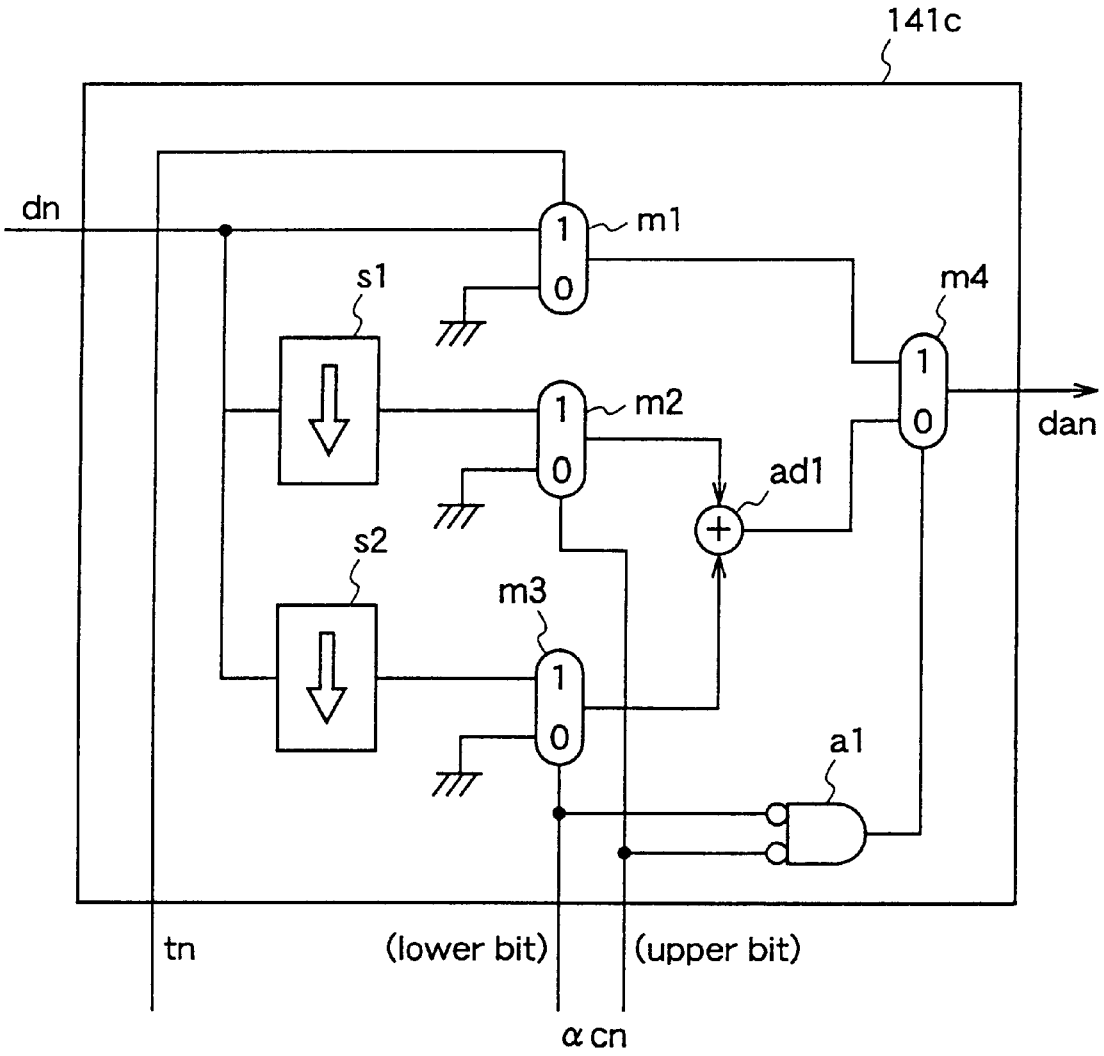
FIG. 9 is a block diagram illustrating the structure of a first multiplier included in the image display apparatus of the third embodiment.

Hereinafter, the first multiplier 141*c* and the second multiplier 142*c* will be described in more detail. FIG. 9 is a block diagram illustrating the structure of the first multiplier 141*c*. The first multiplier 141*c* comprises a first shifter s1, a second shifter s2, multiplexers m1, m2, m3 and m4, an adder ad1, and an AND gate a1.

The first shifter s1 shifts the color data indicated by the color data signal dn, by one bit to the right, when outputting it. That is, assuming that the color data of each of R, G, B is represented by 5 bits, the first shifter s1 outputs a value obtained by multiplying each color data by 0.5. The second shifter s2 shifts the color data indicated by the color data signal dn, by two bits to the right, when outputting it. The second shifter s2 outputs a value obtained by multiplying the color data of each of R, G, and B by 0.25. The adder ad1 adds the values outputs from the multiplexers m2 and m3. The AND gate a1 outputs the AND of the inverted values of the upper bit and the lower bit of the 2-bit transparency code signal αcn. To be specific, when the transparency code signal αcn is "00", the AND gate a1 outputs "1". When it is not "00", the AND gate a1 outputs "0".

The multiplexer m1 outputs "0" when the value of the transparency selection signal tn (control value) is "0", and outputs the color data signal dn as it is when the value of the tn is "1". The multiplexer m2 outputs "0" when the value of the upper bit of the transparency code signal αcn (control value) is "0", and outputs the value from the first shifter s1 when the value of the upper bit of the αcn is "1". The multiplexer m3 outputs "0" when the value of the lower bit of the transparency code signal αcn (control value) is "0", and outputs the value from the second shifter s2 when the value of the lower bit of the αcn is "1".

The multiplexer m4 receives, as a control value, the value output from the AND gate a1 which indicates whether the transparency code is "00" or not, and outputs the value from the multiplexer m1 when the transparency code is "00". Since the output value from the multiplexer m4 is the color data signal dan output from the first multiplier 141*c*, when the transparency selection signal tn is "0", "0" is output as the color data signal dan, and when the transparency selection signal tn is "1", the color data signal an is output as the color data signal dan.

On the other hand, when the transparency code is not "00", the multiplexer m4 outputs the output value from the adder ad1, i.e., the sum of the values output from the multiplexers m2 and m3. In this case, the value of the transparency selection signal tn has no influence on the result. Further, when one of the upper bit and the lower bit of the transparency code is "0", one of the output values from the multiplexers m2 and m3 becomes "0". Accordingly, when the transparency code is "01", the value of the color data signal dan is the output value from the multiplexer m3, and this is equal to the value of the color data multiplied by 0.25. When the transparency code is "10", the value of the color data signal dan is the output value from the multiplexer m2, and this is equal to the value of the color data multiplied by 0.5. When the transparency code is "11", the value of the color data signal dan is the sum of the output values from the multiplexers m2 and m3, and this is equal to the sum of the value of the color data multiplied by 0.25 and the value of the color data multiplied by 0.5. That is, this is equal to the value of the color data multiplexed by 0.75. Consequently, the first multiplier 141*c* multiplies the color data by coefficients 1 shown in FIG. 11, in accordance with the values of the transparency selection signal tn and the transparency code signal αcn.

Figure 10:
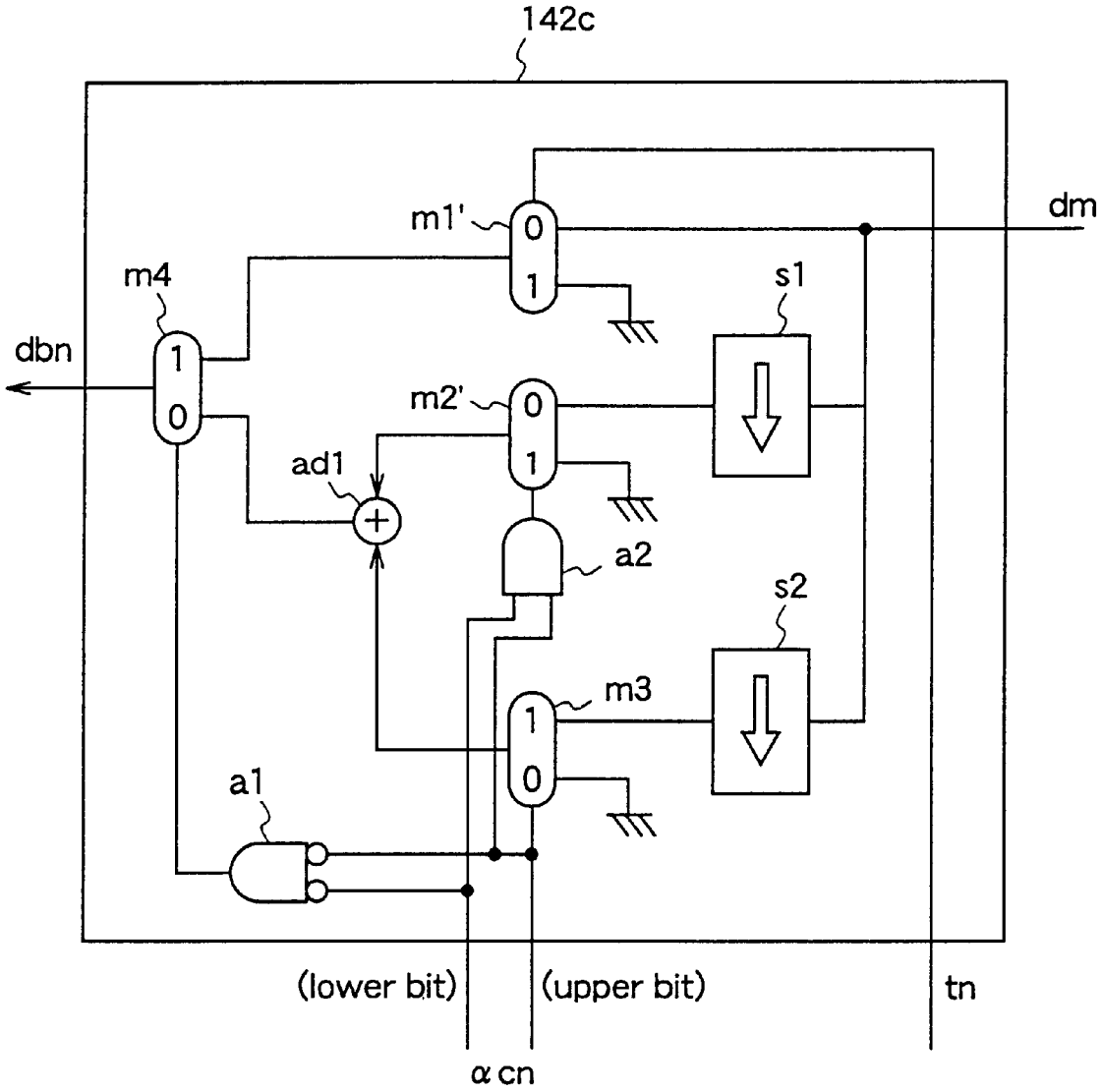
FIG. 10 is a block diagram illustrating the structure of a second multiplier included in the image display apparatus of the third embodiment.
Figure 12:
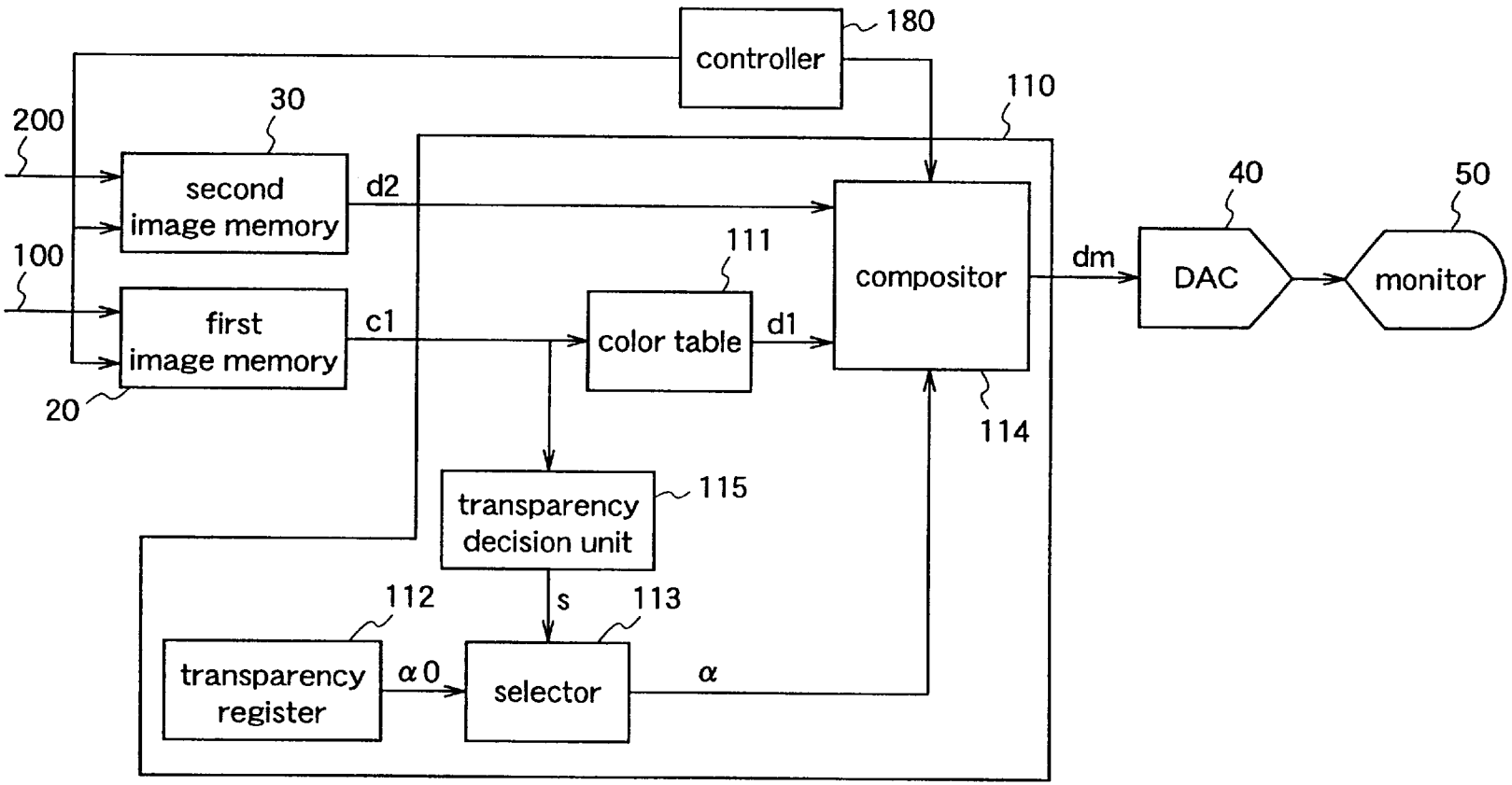
Fig.12 Prior Art
FIG. 12 is a functional block diagram illustrating the structure of the conventional image display apparatus.
Figure 13:
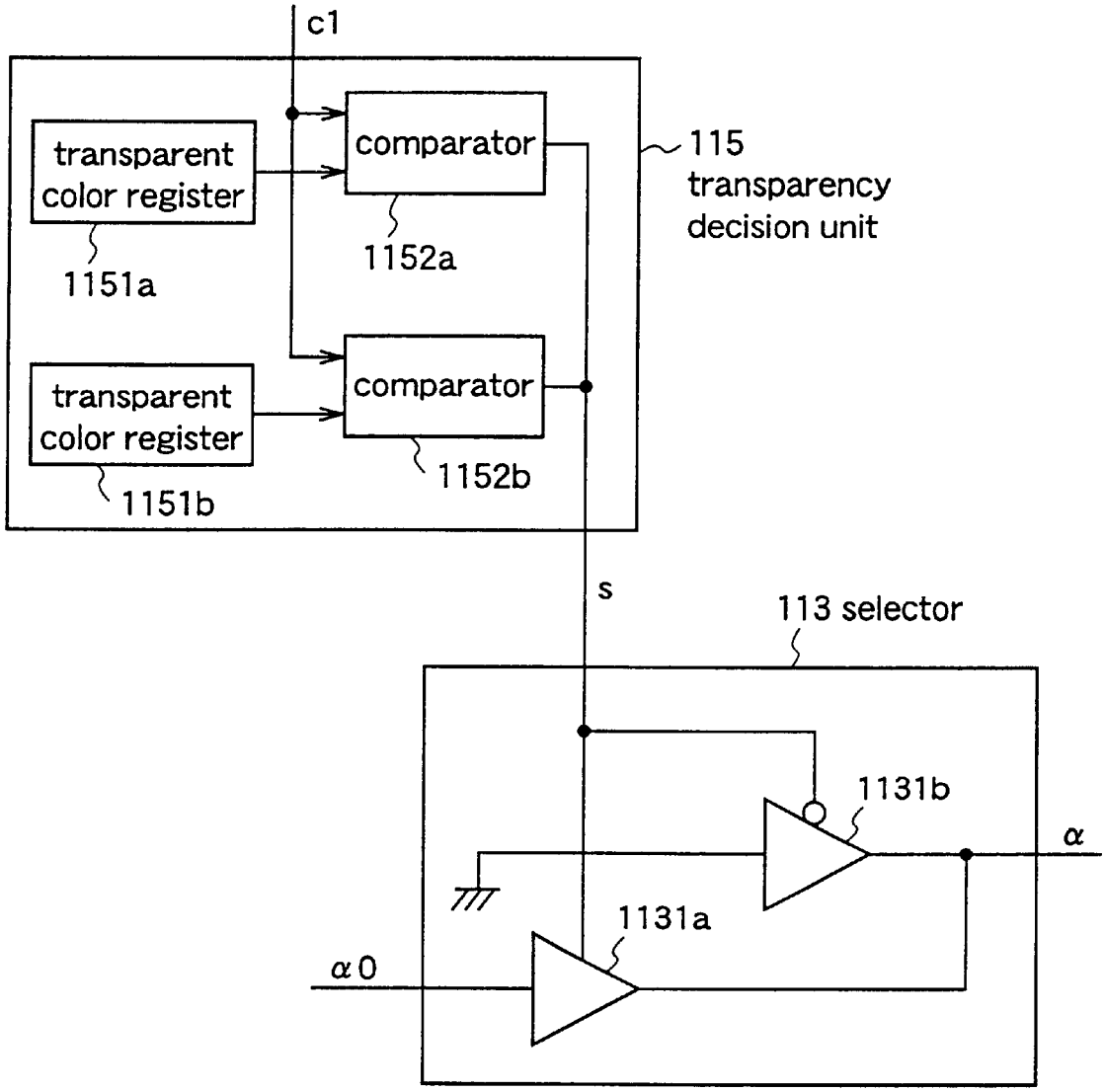
Fig.13 Prior Art
FIG. 13 is a block diagram illustrating the structures of a transparency decision unit and a selector which are included in the conventional image display apparatus.

FIG. 10 is a block diagram illustrating the structure of the second multiplier 142*c*. The second multiplier 142*c* shown in FIG. 10 is fundamentally identical to the first multiplier 141*c* shown in FIG. 9 except that the multiplexers m1 and m2 of the multiplier 141*c* are replaced with multiplexers m1' and m2' which are inverted by the control values, and the multiplexer m2' receives the output from an AND gate a2 which provides the AND of the upper bit and the lower bit of the transparency code signal acn. By constructing the second multiplier 142*c* as shown in FIG. 10, when the transparency code αcn is "00", the output from the multiplexer m1' is the color data signal dbn output from the second multiplier 142*c*. At this time, the color data dbn is the color data dm output from the buffer memory 144*c* when the transparency selection signal tn is "0", and it is "0" when the tn is "1".

Further, when the transparency code αcn is other than "00", the sum of the output values from the multiplexers m2' and m3 is the color data signal dbn. When the transparency code αcn is "01", the color data signal dbn is the sum of the color data signal dm output from the multiplexer m2' and multiplied by 0.5 and the color data signal dm output from the multiplexer m3 and multiplied by 0.25, i.e., the color data signal dm multiplied by 0.75. When the transparency code acn is "10", since "0" is output from the multiplexer m3, the color data signal dbn is equal to the color data signal dm multiplied by 0.5. When the transparency code acn is "11", since "0" is output from the multiplexer m2', the color data signal dbn is equal to the color data signal dm multiplied by 0.25.

The second multiplier 142*c* so constructed multiplies the color data dm by coefficient 2 shown in FIG. 11 in accordance with the values of the transparency selection signal tn and the transparency code signal αcn, and outputs the result of the multiplication. That is, a combination of a transparency selection signal tn and a transparency code signal αcn constitutes a coefficient specification signal which specifies a coefficient by which the color data dm is to be multiplied. Actually, coefficient 1 corresponds to "(α−1)" which is the coefficient of d1 in the above-described formula ① while coefficient 2 corresponds to "α" which is the coefficient of d2, respectively. It is desired that coefficient 1 and coefficient 2 obtained from the same transparency selection signal tn and transparency code signal acn are set so that the sum of them becomes "1".

Further, the color data dn transmitted from the color table 11 to the first multiplier 141c corresponds to "d1" in formula ①, and the color data signal dm transmitted from the buffer memory 144*c* to the second multiplier 142*c* corresponds to "d2" in formula ①. That is, the color data signal dn output from the color table 11 is the first image data to be laid over the second image data, and the color data signal dm output from the buffer memory 144*c* is the second image data on which the first image data is to be laid.

Figure 15:
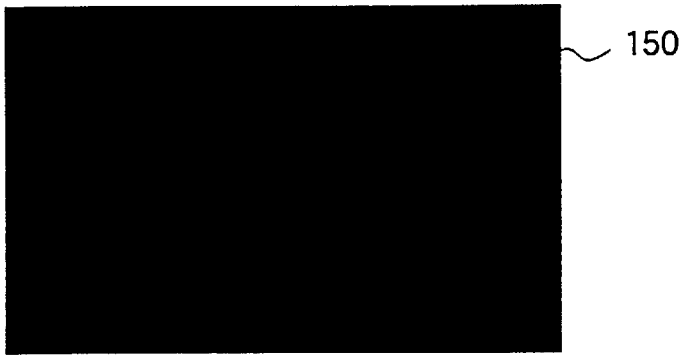
FIGS. 15(*a*)–15(*d*) are diagrams illustrating examples of images to be composed (15(*a*)–15(*c*)) and an example of a composite image (15(*d*)), for explaining the image display apparatus of the third embodiment.
Figure 15:
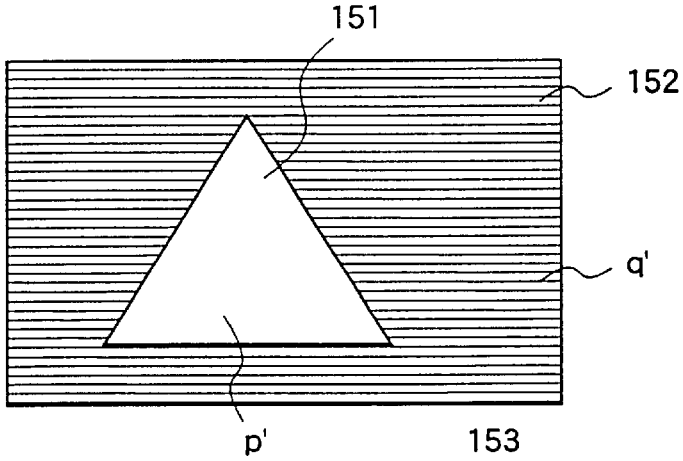
Figure 15:
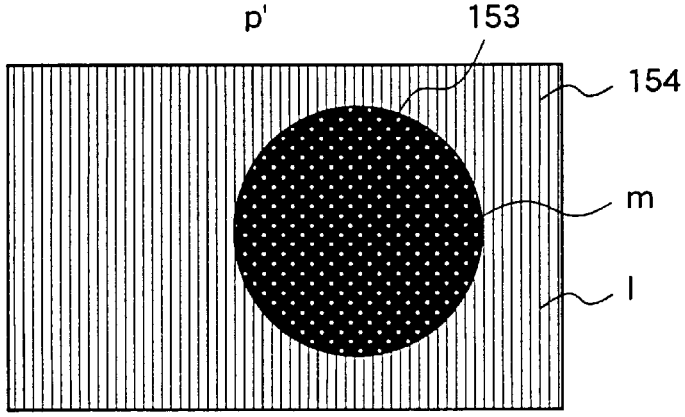
Figure 15:
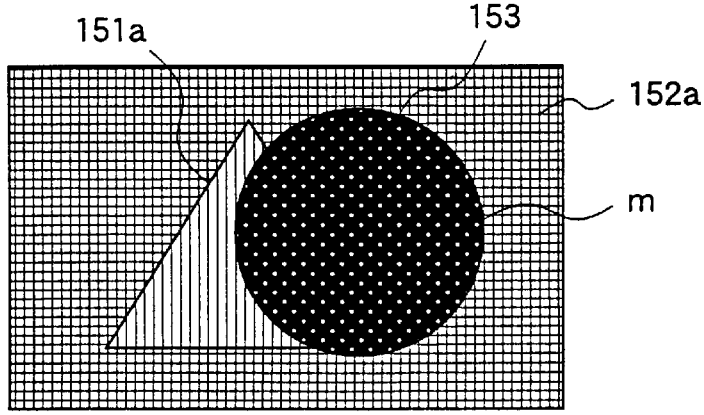

Next, the operation of the image display apparatus 1C so constructed will be described with reference to FIGS. 15(*a*) ~15(*d*). In the image memory 20C, image data of an image shown in FIG. 15(*b*) and image data of an image shown in FIG. 15(*c*) are stored, pixel by pixel, as a color code indicating the color of each pixel. In the background color data register 60, for each of R, G, and B, "00000" is stored as color data of pixels assumed as a backmost color of an area 150 over the screen, as shown in FIG. 15(*a*). That is, all of the pixels of the backmost image are black. However, the color of the backmost image is not restricted to black. In the color table 11, transparency selection data T(p') and T(q') corresponding to a color code p' of a triangle area 151 shown in FIG. 15(*b*) and a color code q' of the other area 152, respectively, are set to "1". Further, transparency selection data T(m) corresponding to a color code m of a circular area 153 shown in FIG. 15(*c*) is set to "1" while transparency selection data T(l) corresponding to a color code l of the other area 154 is set to "0". In the transparency code register 121*c* to be selected when the transparency selection data is "1", "00" is set as a transparency code αca. In the transparency code register 122*c* to be selected when the transparency selection data is "0", "10" is set as a transparency code αcb.

Initially, under control of the controller 80, color data d0 of black which is the backmost color of the entire screen shown in FIG. 15(*a*) is output by one line of data, in order of scan lines of the monitor 50, from the background data register 60 to the buffer memory 144*c*, and the output color data d0 is stored in the storage locations of the corresponding pixels to be processed.

Subsequently, the color codes of pixels corresponding to one scan line of the image shown in FIG. 15(*b*) (first image) are output as color code signals cl from the image memory 20C to the color table 11, and then the color data signals d1 corresponding to the color codes are output from the color table 11 to the first multiplier 141*c* of the compositor 14*c*. Assuming that the pixels are read in order starting from the top of the image, the color code q' is output as the color code signal cl corresponding to all of the pixels in the line, from the image shown in FIG. 15(*b*).

The color table 11 outputs the color data signal d1 corresponding to one line and, simultaneously, outputs a transparency selection signal t1 corresponding to the color code of each pixel in this line, to the selector 13*a*. The selector 13*a* selects one of the transparency codes stored in the transparency code registers 121*c* and 122*c* according to the value of the transparency selection signal t1, and outputs it as a transparency code signal αc1 to the first multiplier 141*c* and the second multiplier 142*c* in the compositor 14*c*. Since the transparency selection signal t1 with respect to the color code q' which has been output as the color data signal d1 for each pixel in the first line, is "1", the transparency code signal αc1 is "00" for each pixel.

In the first multiplier 141*c*, the color data signal d1 transmitted from the color table 11 is subjected to predetermined arithmetic, pixel by pixel, according to the values of the transparency selection signal t1 and the transparency code signal αc1, and the result of arithmetic is output as a color data signal da1 to the adder 143*c*. Since the transparency selection signal t1 is "1" and the transparency code signal αc1 is "00", the first multiplier 141*c* multiplies each pixel of the color data signal d1 by "1.00" as coefficient 1 with reference to the table of FIG. 11, and outputs the product as a color data signal da1.

In the second multiplier 142*c*, the color data signal dm corresponding to the pixels in one line being processed, which is transmitted from the buffer memory 144*c*, to predetermined arithmetic, pixel by pixel, according to the values of the transparency selection signal t1 and the transparency code signal αc1, and the result of arithmetic is output as a color data signal db1 to the adder 143*c*. Since the transparency selection signal t1 is "1" and the transparency code signal αc1 is "00", the second multiplier 142*c* multiplies each pixel of the color data signal dm by "0.00" with reference to the table of FIG. 11, and outputs the product as a color data signal db1.

In the adder 143*c*, the color data signal da1 and the color data signal db2 are added pixel by pixel, and each sum is output to the buffer memory 144*c*. In the buffer memory 144*c*, the transmitted color data overwrites the color data in the storage location of the corresponding pixel in the line being processed.

Subsequently, the color codes of pixels constituting one scan line of the second image shown in FIG. 15(*c*) are output as color code signals c2 to the color table 11, and subjected to the same processing as that for the color data of the first image. Also in this case, since the color codes are read in order starting from the uppermost line of the image, the color code l is output for all of the pixels constituting this line, as color code signals c2, to the image memory 20c. With respect to this color code l, the transparency selection signal t2 is "0" and the transparency code signal αc2 is "10". In the first multiplier 141*c*, according to the transparency selection signal t2 and the transparency code signal αc2, the color data signal d2 corresponding to each pixel, which is output from the color table 11 in accordance with the color code signal c2, is multiplied by "0.5", and the product is output to the adder 143*c*. In the second multiplier 142*c*, the color data signal dm2 corresponding to each pixel, which is output from the buffer memory 144*c*, is multiplied by "0.5", and the product is output to the adder 143*c*. In the adder 143*c*, these products are added pixel by pixel, and the sum is output to the buffer memory 144*c* to overwrite the color data in the storage location of the corresponding pixel in the line being processed. In this third embodiment, since only two frames of image data are stored in the image memory 20C, the processing for the first one scan line is completed. The composite data is output as a composite data signal dm to the digital-to-analog converter 40 and then displayed on the monitor 50. By performing the above-described processing for all of the scan lines, the color data of the first image and the color data of the second image are composed.

With respect to the colors of the image of FIG. 15(*b*), the transparency selection data is "1" and the transparency code is "00". Therefore, with reference to the table of FIG. 11, "1.00" and "0.00" are adopted as coefficient 1 and coefficient 2, respectively, and all of the pixels are subjected to the processing with the transparency "0.00" and the result of the processing overwrites the background color data of the corresponding pixels in the buffer memory 144*c*.

With respect to the image of FIG. 15(*c*), for the color code m of the pixels constituting the circular area 153, the transparency selection data is set to the same value as that for the colors of the image of FIG. 15(*b*). So, the pixels constituting this color are subjected to the processing with the transparency "0.00", and the result of the processing overwrites the color data in the storage locations of the corresponding pixels in the buffer memory 144*c*.

With respect to the area 154 other than the circular area 153 in FIG. 15(*c*), since the transparency selection data corresponding to the color code l of this area is "0", the transparency code is "10". Therefore, with reference to the table of FIG. 11, "0.50"and "0.50" are adopted as coefficient 1 and coefficient 2, respectively, and the pixels constituting this color are subjected to the processing with the transparency "0.50" and the result overwrites the color data in the storage locations of the corresponding pixels in the buffer memory 144*c*. As the result, the image of FIG. 15(*b*) and the image of FIG. 15(*c*) are composed such that the image of FIG. 15(*c*), having the circular area 153 being opaque and the other area 154 being semi-transparent, is laid over the image of FIG. 15(*b*), as shown in FIG. 15(*d*). To be specific, the color data of the circular area 153 is obtained by the color code m. In a portion 15l*a* of the triangle area 151 other than the overlapped portion with the circular area 153, the color data obtained by the color code l (semi-transparent) is composed with the color data obtained by the color code p'. In a portion 152*a* of the area 152 outside the triangle area 151 and other than the overlapped portion with the circular area 153, the color data obtained by the color code l (semi-transparent) is composed with the color data obtained by the color code q'.

In the image data composition unit 10C according to this third embodiment, the coefficient specification signal is constituted by not only the transparency code but also the transparency selection data, and the coefficients used for multiplication by the multipliers in the compositor 14*c* are decided on the basis of the coefficient specification signal. Therefore, it is possible to realize multiplications using combinations of coefficients each being represented by combining the number of bits of the transparency code and the number of bits of the transparency selection data. Thereby, the number of bits of the transparency codes can be reduced, and the signal lines within the selector 13*a* and the signal lines extended to the selector 13*a* can be reduced, resulting in more efficiently utilization of the circuit installed area.

Further, the coefficients corresponding to the transparencies used for multiplication by the first and second multipliers 141*c* and 142*c* can be represented by powers of 2 or the sum of powers of 2, such as 1.0, 0.5, 0.25, 0.75 (i.e., $2^0$, $2^{-1}$, $2^{-2}$, $2^{-1}+2^{-2}$). Therefore, in each of the multipliers 141*c* and 142*c*, multiplication using the coefficients can be represented by only shifting of color data signals and addition of results of shifting, whereby the multiplier can be implemented by a relatively simple logic circuit. Further, multiplication using the coefficients corresponding to the transparencies can be specified with less number of bits, whereby the transparency table employed in the second embodiment can be dispensed with.

Also in this third embodiment, in order to efficiently utilize the storage capacity of the color table 11, two-bit transparency codes αca and αcb are stored in the transparency code registers 121*c* and 122*c*, and one of them is selected according to the value of 1-bit transparency selection data stored in the color table 11. Then, the 1-bit transparency selection signal and the selected 2-bit transparency code signal are combined to provide a coefficient specification signal, and the compositor performs multiplication by using coefficients on the basis of the coefficient specification signal. However, if the storage capacity of the color table 11 is sufficiently large, the 1-bit transparency selection data may be replaced with 3-bit transparency data. This 3-bit data is directly input to the compositor 14*c* as a coefficient specification signal, and multiplication by using coefficients is performed in the multipliers on the basis of the 3-bit data. In this case, the transparency code registers 121*c* and 122*c* and the selector 13*a* can be dispensed with. Further, the number of transparencies to be used at the same time can be increased without increasing the circuit scale.

Further, instead of the transparency code registers 121*c* and 122*c* and the selector 13*a*, a table having addresses each comprising 1 bit may be used. In this case, the transparency codes αca and αcb are stored in each address, and the transparency code stored in the address equal to the value of the transparency selection signal tn is output as a transparency code signal αcn.

In this third embodiment, in advance of composition of image data, the color data stored in the background color data register 60 is written in the buffer memory 144*c*, whereby the buffer memory 144*c* is filled with the background color data to delete the data obtained by the previous composition. When all of color data constituting an image to be initially read from the image memory are opaque, the image to be initially read consequently becomes the backmost image. In this case, it is not necessary to read the color data stored in the background color data register into the buffer memory 144*c* and, therefore, the background color data register 60 can be dispensed with.

Moreover, in this third embodiment, image data are read by one scan line at a time to perform line-by-line data composition. However, the number of pixels to be processed at a time may be arbitrarily set. For example, image data constituting one frame may be read at a time for frame-by-frame data composition, or image data may be read by one pixel at a time for pixel-by-pixel data composition. This holds good for the first and second embodiments of the invention.

Furthermore, in this third embodiment, two frames of image data are stored in the image memory 20C, and these image data are composed. However, the number of frames of image data to be stored in the image memory 20C is not restricted thereto. In any case, image data which is later read from the image memory 20C overwrites the composition result of image data which have previously been read from the memory 20C, whereby the same effect as described for the third embodiment is obtained.

Furthermore, while in the aforementioned embodiments of the invention the number of transparencies which can be set at the same time is two, this number can be arbitrarily increased when the number of selectable transparencies or transparency codes is increased by increasing the number of bits of transparency selection data.

What is claimed is:

1. An image data composition apparatus comprising:

a color table in which color data for each of plural color codes is associated with transparency data relating to a transparency of the color data, said color table operable to receive first image data which has data relating to a color of an image as a color code, accept the color code from the first image data, and output the color data and the transparency data which correspond to the color code;

a composition unit operable to receive second image data having, as color data, information relating to the color of an image and composing the color data of the second image data with the color data output from said color table in accordance with a transparency which is decided by the transparency data;

a first multiplier operable to accept a coefficient specification signal which is composed of at least one bit decided by the transparency data, specify a first coefficient corresponding to the transparency of the color data of the first image data in accordance with the coefficient specification signal, and multiply the color data of the first image data by the first coefficient;

a second multiplier operable to accept the coefficient specification signal, specify a second coefficient corresponding to the transparency of the color data of the second image data in accordance with the coefficient specification signal, and multiply the color data of the second image data by the second coefficient; and an adder operable to add the products which are output from said first multiplier and said second multiplier.

2. An image data composition apparatus as claimed in claim 1, further comprising:

an image memory operable to store the first image data which has the data relating to the color of the image as the color code.

3. An image data composition apparatus as claimed in claim 1, further comprising:

a background color data register operable to store the second image data having, as the color data, information relating to the color of the image.

4. An image data composition apparatus comprising:

a color table in which color data for each of plural color codes is associated with transparency data relating to a transparency of the color data, said color table operable to receive first image data which has data relating to a color of an image as a color code, accept the color code from the first image data, and output the color data and the transparency data which correspond to the color code;

a composition unit operable to receive second image data having, as color data, information relating to the color of an image and composing the color data of the second image data with the color data output from said color table in accordance with a transparency which is decided by the transparency data;

a first multiplier operable to accept a coefficient specification signal which is composed of at least one bit decided by the transparency data, specify a first coefficient corresponding to the transparency of the color data of the first image data in accordance with the coefficient specification signal, and multiply the color data of the first image data by the first coefficient;

a second multiplier operable to accept the coefficient specification signal, specify a second coefficient corresponding to the transparency of the color data of the second image data in accordance with the coefficient specification signal, and multiply the color data of the second image data by the second coefficient;

a transparency code storage unit operable to store at least two transparency codes each being composed of at least one bit;

a transparency code selection unit operable to select one of the transparency codes stored in said transparency code storage unit on a basis of the transparency data;

wherein said transparency data is composed of at least one bit, and the coefficient specification signal is composed of the transparency data and the transparency code; and an adder operable to add the products which are output from said first multiplier and said second multiplier.

5. An image data composition apparatus as claimed in claim 4, further comprising:

an image memory operable to store the first image data which has the data relating to the color of the image as the color code.

6. An image data composition apparatus as claimed in claim 4, further comprising:

a background color data register operable to store the second image data having, as the color data, information relating to the color of the image.

7. An image display apparatus comprising:

a color table in which color data for each of plural color codes is associated with transparency data relating to a transparency of the color data, said color table operable to receive first image data which has data relating to a color of an image as a color code, accept the color code from the first image data, and output the color data and the transparency data which correspond to the color code;

a composition unit operable to receive second image data having, as color data, information relating to the color of an image and composing the color data of the second image data with the color data output from said color table in accordance with a transparency which is decided by the transparency data;

a first multiplier operable to accept a coefficient specification signal which is composed of at least one bit decided by the transparency data, specify a first coefficient corresponding to the transparency of the color data of the first image data in accordance with the coefficient specification signal, and multiply the color data of the first image data by the first coefficient;

a second multiplier operable to accept the coefficient specification signal, specify a second coefficient corresponding to the transparency of the color data of the second image data in accordance with the coefficient specification signal, and multiply the color data of the second image data by the second coefficient; and an adder operable to add the products which are output from said first multiplier and said second multiplier.

8. An image display apparatus as claimed in claim 7, further comprising:

an image memory operable to store the first image data which has the data relating to the color of the image as the color code.

9. An image display apparatus as claimed in claim 7, further comprising:

a background color data register operable to store the second image data having, as the color data, information relating to the color of the image.

10. An image display apparatus as claimed in claim 7, further comprising:

a monitor operable to display an image in accordance with an output from said adder.

11. An image display apparatus comprising:

a color table in which color data for each of plural color codes is associated with transparency data relating to a transparency of the color data, said color table operable to receive first image data which has data relating to a color of an image as a color code, accept the color code from the first image data, and output the color data and the transparency data which correspond to the color code;

a composition unit operable to receive second image data having, as color data, information relating to the color of an image and composing the color data of the second image data with the color data output from said color table in accordance with a transparency which is decided by the transparency data;

a first multiplier operable to accept a coefficient specification signal which is composed of at least one bit decided by the transparency data, specify a first coefficient corresponding to the transparency of the color data of the first image data in accordance with the coefficient specification signal, and multiply the color data of the first image data by the first coefficient;

a second multiplier operable to accept the coefficient specification signal, specify a second coefficient corresponding to the transparency of the color data of the second image data in accordance with the coefficient specification signal, and multiply the color data of the second image data by the second coefficient;

a transparency code storage unit operable to store at least two transparency codes each being composed of at least one bit; and a transparency code selection unit operable to select one of the transparency codes stored in said transparency code storage unit on a basis of the transparency data;

wherein said transparency data is composed of at least one bit, and the coefficient specification signal is composed of the transparency data and the transparency code; and an adder operable to add the products which are output from said first multiplier and said second multiplier.

12. An image display apparatus as claimed in claim 11, further comprising:

an image memory operable to store the first image data which has the data relating to the color of the image as the color code.

13. An image display apparatus as claimed in claim 11, further comprising:

a background color data register operable to store the second image data having, as the color data, information relating to the color of the image.

14. An image display apparatus as claimed in claim 11, further comprising:

a monitor operable to display an image in accordance with an output from said adder.

* * * * *